US006138391A

United States Patent [19]

Ngan

[11] Patent Number: 6,138,391

[45] Date of Patent: Oct. 31, 2000

[54] CALENDAR

[76] Inventor: Chi Lung Ngan, 5 Bradford Rd., Edison, N.J. 08820

[21] Appl. No.: 09/282,143

[22] Filed: Mar. 31, 1999

[51] Int. Cl.[7] ..... G09D 3/00

[52] U.S. Cl. ..... 40/119; 40/121

[58] Field of Search ..... 40/107, 110, 121, 40/119

[56] References Cited

U.S. PATENT DOCUMENTS

| | | | |
|---|---|---|---|
| 1,583,666 | 5/1926 | Crooker . | |
| 2,574,899 | 11/1951 | Waring | 40/119 |
| 3,975,848 | 8/1976 | Schmid | 40/110 |
| 4,793,080 | 12/1988 | Tangorra . | |
| 4,902,042 | 2/1990 | Rassi . | |
| 5,123,191 | 6/1992 | Kim . | |
| 5,135,260 | 8/1992 | Irlik . | |

FOREIGN PATENT DOCUMENTS 515150 8/1955 Canada .

*Primary Examiner*—Cassandra H. Davis
*Attorney, Agent, or Firm*—Shlesinger, Arkwright & Garvey LLP

[57] ABSTRACT

A calendar which includes a stack of monthly calendars having month and each day of the week indicia, and which is provided with a top cover having a series of separate apertures therein registering respectfully with the top monthly calendar month and each day of the month indicia. The top monthly calendar can be removed from beneath the top cover so as to present the next succeeding monthly calendar in position beneath the top cover and in registering relationship with the series of separate apertures provided.

5 Claims, 2 Drawing Sheets

CALENDAR

FIELD OF THE INVENTION

This invention relates to calendars and more particularly to a wall hanging calendar which does not require the calendar to be removed from the wall each time a new month comes up or with standard spiral type multi-page calendars which does not require rotating of the pages from front to back to reveal the next succeeding calendar month.

BACKGROUND OF THE INVENTION

Various desktop and wall hanging calendars have been available for centuries. Spiral type calendars such as Rassi U.S. Pat. No. 4,902,042 and Irlik U.S. Pat. No. 5,135,260 are typical. Perpetual calendars such as Crooker U.S. Pat. No. 1,583,666 and Tangorra U.S. Pat. No. 4,793,080 are other variations of calendars. Changeable calendars with indicia seen through openings are illustrated in Potter Canadian patent 515,150. Most of the wall mounted calendars today require removal from the wall in order to change the month. Similarly most of the desk typed calendars require flipping of the pages to change the month. Such calendars, require substantial effort to change the month.

OBJECTS AND SUMMARY OF THE INVENTION

An object of this invention to provide a structurally improved calendar for wall hanging which does not require removal from the wall in order to change the month.

Yet another object of this invention is to provide a calendar which if used as a desk type calendar does not require the flipping of pages in order to present a new month.

Still a further object of this invention is to provide a calendar which is sturdy and simple in construction.

A further object of this invention is to provide a calendar which provides additional information which is hidden under normal circumstances but which can be readily revealed by a simple lifting of the top cover.

Another object of this invention is to provide advertising space which will be readily available and visible when freely hanging.

A further object of this invention is to provide a calendar which permits the viewer to see indicia of at least a portion of at least one of either the next succeeding or the last preceding month indicia.

In summary, the present invention relates to a calendar which may be wall mounted or desk mounted and which readily displays the next succeeding month without having to flip pages.

BRIEF DESCRIPTIONS OF THE DRAWINGS

Other objects of this invention will be apparent from the following detailed description and the accompanying drawings which are as follows.

DESCRIPTION

Figure 1:
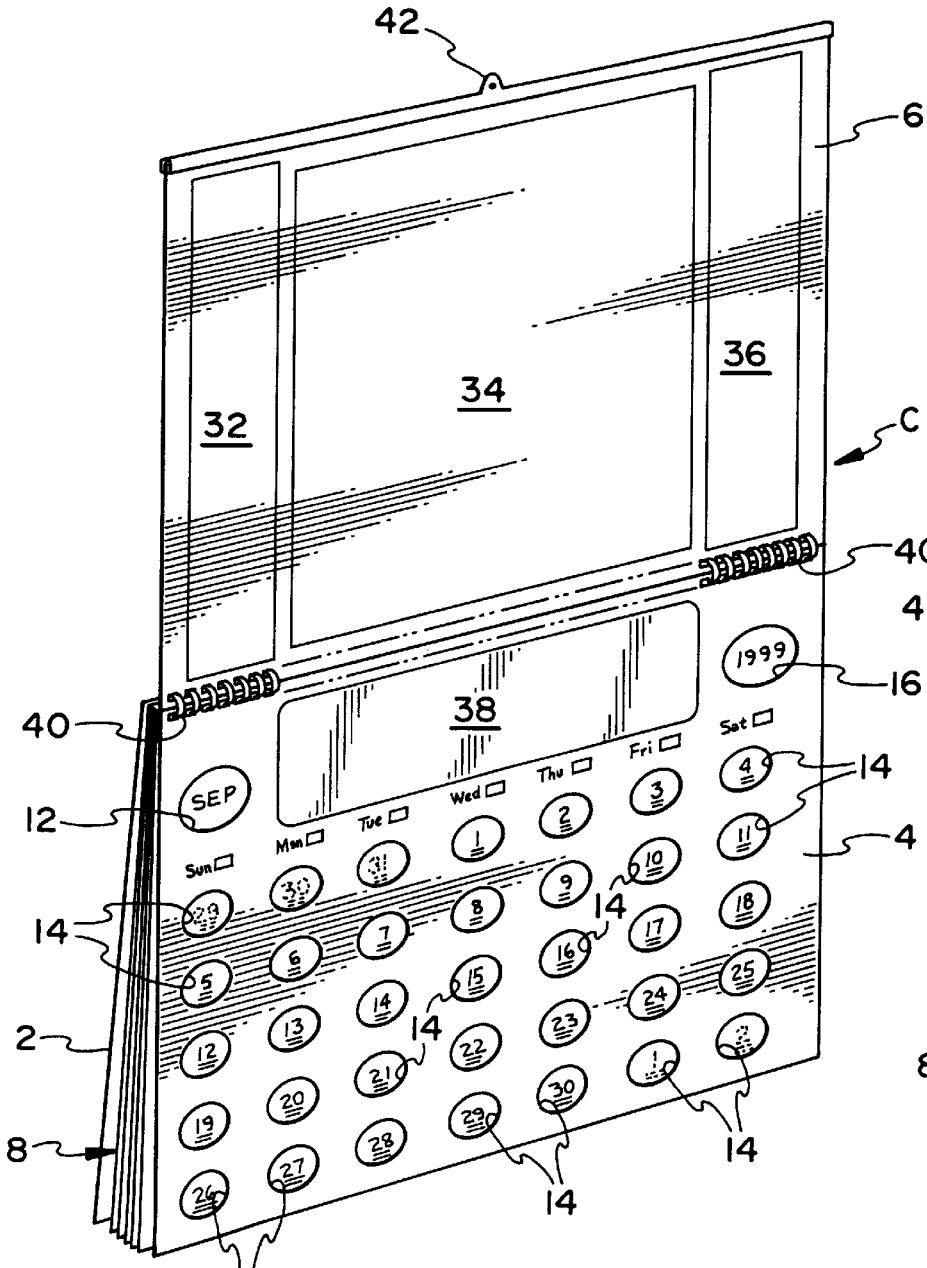
FIG. 1 is a perspective of the calendar of this invention.
Figure 3:
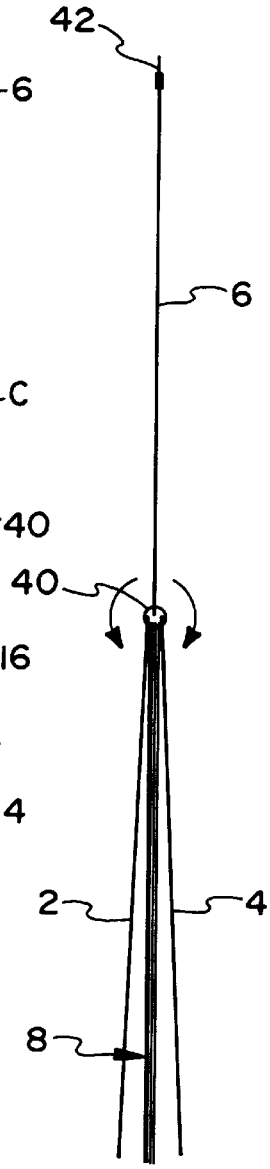
FIG. 3 is a side elevational view of the calendar.

As best shown in FIGS. 1 and 3, the calendar C includes a back cover 2, a top cover 4 and a dress cover 6. Between the back cover 2 and the top cover 4 is positioned a stack of monthly calendars 8. Each calendar C of the stack of monthly calendars 8 has a top monthly calendar 10 best shown in FIG. 2.

Figure 2:
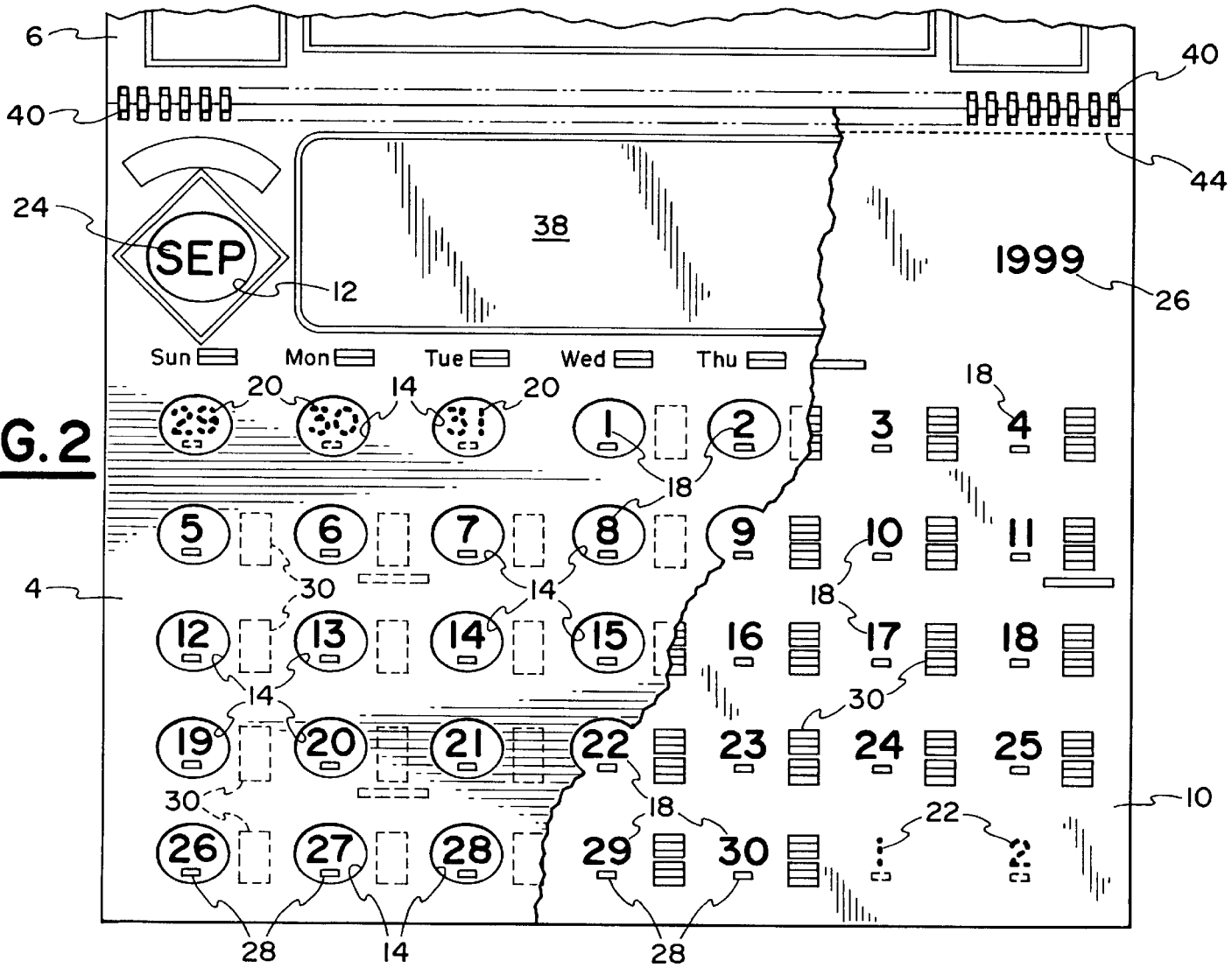
FIG. 2 is a fragmentary top plan view of the calendar with portions broken away.

Top cover 4 includes a month aperture 12 and days of the week apertures 14. As illustrated in FIGS. 1 and 2, a year aperture 16 may be provided if the stack of monthly calendars 8 exceed 12 months and extends into the following or previous year. If the calendar C is an annual calendar, the year aperture 16 need not be included and the year can be printed in indicia on the top cover 4. The top monthly calendar 10 includes five successive rows of seven apertures. These are sufficient to show day indicia 18 of the month as well as day indicia of the last proceeding month 20 and day indicia of the next succeeding month 22. The month aperture 12 shows beneath it on the top monthly calendar 10 the month of September indicia 24. The aperture 16 discloses the year 1999 indicia 26.

Besides the Arabic numerals for the month, beneath the Arabic numerals or in some place adjacent thereto, but invisible through the aperture 18 could be second language indicia such as chinese or japanese characters indicating the day of the week whether lunar or gregorian indicia. FIG. 2 illustrates the additional indicia 28 beneath the Arabic numerals indicia day of the month 18. On the monthly calendars 8 such as seen in FIG. 2, additional information indicia 30 can be included. The indicia 30 can be weather prognostications, sayings, or recommendations for that particular day or the like.

The dress cover 6 and top cover 4 can compliment each other as far as pictorial or art work is concerned. Panels 32, 34, 36 and 38 provide areas for decorative material or advertising or the like. A special finish can be applied to the top cover 4 to allow subsequent printing to be applied such as advertising or the like (not shown).

In FIG. 3, it is obvious that the dress cover 6 can be swung in either direction left or right to either impose itself on back cover 2 or on to top cover 8 when shipped or lying as a desk calendar. A spiral hinge 40 is provided to permit the stack of calendars 8 and the back cover 2, top cover 4 and dress cover 6 as well as the stack of monthly calendars 8 to be moved. It is obvious that the spiral hinge 40 may comprise any type of hinge mechanism including rings etc. which permits the various parts of the calendar C such as the back cover 2, the top cover 4, the dress cover 6, and the stack of monthly calendars 8 to be flipped over.

The additional indicia 30, which is hidden by the top cover 4 under normal circumstances, can be readily viewed by lifting the top cover 4.

Each of the stack of monthly calendars 8 may be provided with scoring 44 to permit ready removal of that particular calendar that is on the top to expose the next succeeding monthly calendar. It is obvious that the top monthly calendar 10 may be stripped from the spiral hinge 40 in typical spiral notebook fashion without the scoring 44.

OPERATION

It is now obvious that in operating the calendar C, it will be hung on the wall by means of a hook or nail or the like 42. The top cover 10 will visually display all of the indicia available on the top monthly calendar 10 through the apertures 18, 24 and 26 as the case may be. In order to bring up the next succeeding month which will then be visible through the various apertures 12, 14 and 16, the top monthly calendar 10 will be stripped from the stack of monthly calendar 8 to bring the next succeeding monthly calendar into view.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A calendar comprising:

a) a stack of monthly calendars each including month and each day of the week indicia, b) said stack of monthly calendars being successively stacked from one monthly calendar to a next succeeding monthly calendar, c) said stack of monthly calendars having a top monthly calendar, d) a top cover positioned on top of said top monthly calendar, e) said top cover having a series of separate apertures therein registering respectively with said top monthly calendar month and each day of the month indicia, f) separating means for removing said top monthly calendar from said stack of monthly calendars and positioning said next succeeding monthly calendar directly beneath said top cover and registering respectively said series of separate apertures with said next succeeding monthly calendar month and each day of the month indicia as said next succeeding monthly calendar becomes said top monthly calendar; and, g) secondary indicia on said monthly calendars adjacent each day of the month indicia, and said secondary indicia being positioned out of registry with said top cover separate apertures when a monthly calendar becomes said top monthly calendar.

2. A calendar as in claim 1 and including:

a) a dress cover covering said top cover;

b) a cooperating color scheme on said top cover and said dress cover.

3. A calendar as in claim 2 and wherein:

a) said dress cover includes means for wall hanging said calendar.

4. A calendar as in claim 3 and including:

a) a designated advertising area on at least said top cover.

5. A calendar as in claim 3 and including:

a) a designated advertising area on at least said dress cover.

* * * * *